United States Patent [19]

Wu

[11] Patent Number: 4,663,635

[45] Date of Patent: May 5, 1987

[54] MOUNT FOR PARABOLIC ANTENNA OR THE LIKE

[75] Inventor: Henry Wu, Taipei, Taiwan

[73] Assignee: Ching Jun Lai, Taiwan

[21] Appl. No.: 689,963

[22] Filed: Jan. 9, 1985

[51] Int. Cl.[4] ..... H01Q 1/12

[52] U.S. Cl. ..... 343/765; 343/882; 74/89.14; 74/625; 248/183

[58] Field of Search ..... 343/765, 766, 757, 840, 343/878, 882, 915; 248/183, 187, 515, 185, 186; 350/568; 74/1 R, 383, 89.14, 425, 421 A, 606 R, 625

[56] References Cited

U.S. PATENT DOCUMENTS 4,126,865 11/1978 Longhurst et al. ..... 343/766

4,541,294 9/1985 Byers ..... 74/89.14

*Primary Examiner*—Eli Lieberman

*Assistant Examiner*—Michael C. Wimer

*Attorney, Agent, or Firm*—Bacon & Thomas

[57] ABSTRACT

The present invention relates to an improved mount for parabolic antenna and in particular to one comprising a base, a swivel table rotatably mounted on the base, a gear box fastened on the swivel table, a driving rod having at one end a worm disposed in the gear box, a driven rod having at one end a worm gear engaged with the worm of the driving rod and at the middle portion a worm protruding from the gear box, a main worm gear meshing with the worm of the driven rod, a pad disposed between the main worm gear and the swivel table, and a supporting frame fixed on the main worm gear.

4 Claims, 4 Drawing Figures

MOUNT FOR PARABOLIC ANTENNA OR THE LIKE

BACKGROUND OF THE INVENTION

The present invention relates to an improved mount for parabolic antenna or the like. A parabolic antenna is a device using some form of a paraboloidal mirror either to convert plane waves into spherical waves or to convert spherical waves into plane waves. However, the mount for parabolic antenna on the market is bulky and difficult to assemble. Attempts have been made to eliminate such drawbacks, but none of them was led to satisfactory results.

With reference to FIG. 4, there is shown a prior art mount for parabolic antenna. However, the prior art mount is bulky and therefore expensive to manufacture and are visually unappealing. Furthermore, it tends to be somewhat unstable and cannot provide accurate control of the direction thereof.

It is, therefore, an object of the present invention to provide an improved mount for parabolic antenna which may obviate and mitigate the above-mentioned drawbacks.

SUMMARY

It is the primary object of the present invention to provide an improved mount for parabolic antenna which is simple in construction.

It is another object of the present invention to provide an improved mount for parabolic antenna which is easy to assemble.

It is still another object of the present invention to provide an improved mount for parabolic antenna which is easy to use.

It is still another object of the present invention to provide an improved mount for parabolic antenna which is economical to produce.

It is still another object of the present invention to provide an improved mount for parabolic antenna which is easy to carry.

It is a further object of the present invention to provide an improved mount for parabolic antenna which provides accurate control of direction.

DETAILED DESCRIPTION OF THE PREFERRED EMBODIMENT

Before explaining the present invention in detail, it is to be understood that the invention is not limited in its application to the details of construction and arrangement of parts illustrated in the accompanying drawings, since the invention is capable of other embodiments and of being practiced or carried out in various ways. Also it is to be understood that the phraseology or terminology employed herein is for the purpose of description and not of limitation.

Figure 1:
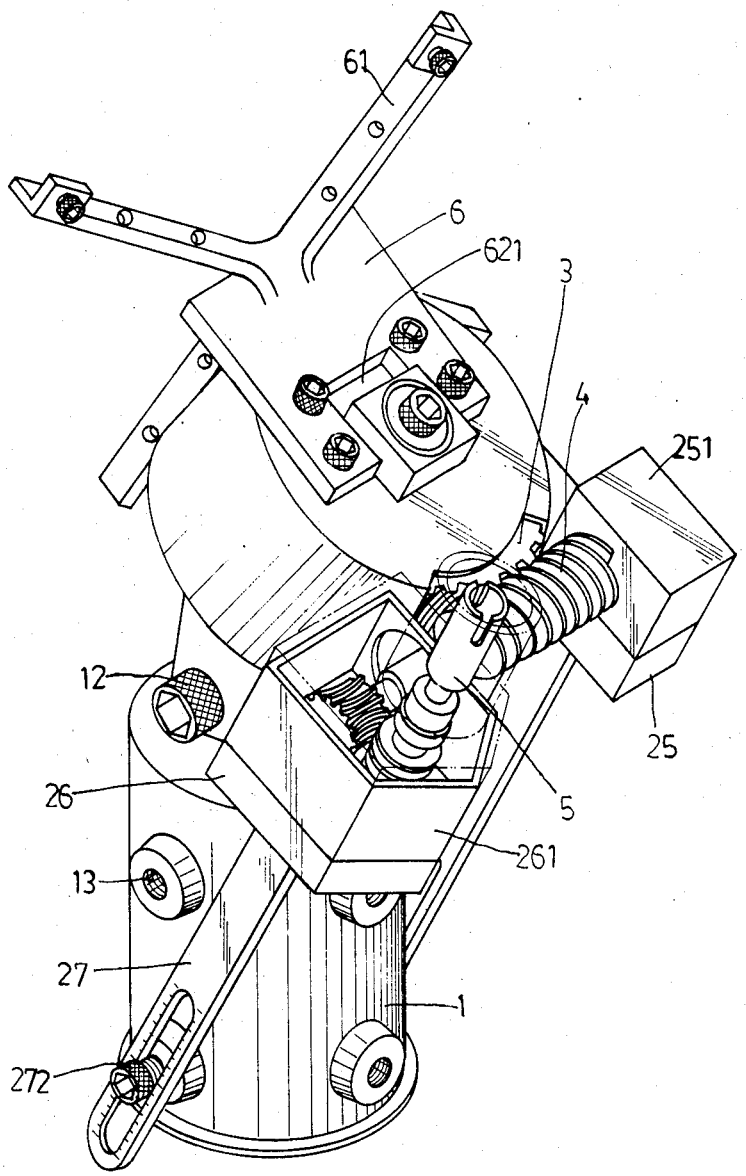
FIG. 1 is a perspective view of an improved mount for parabolic antenna according to a preferred embodiment of the present invention.
Figure 2:
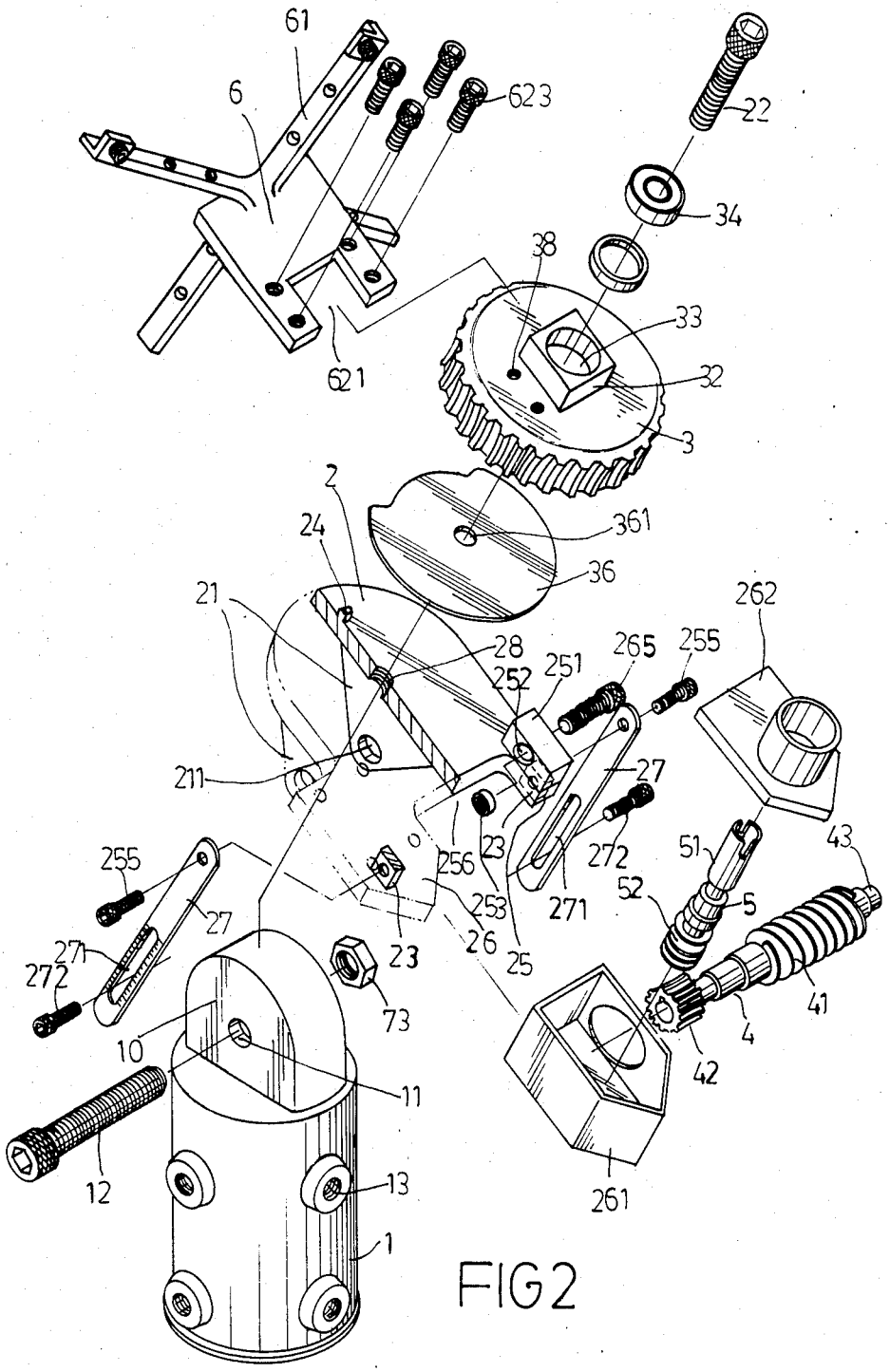
FIG. 2 is an exploded view of the improved mount for parabolic antenna.
Figure 3:
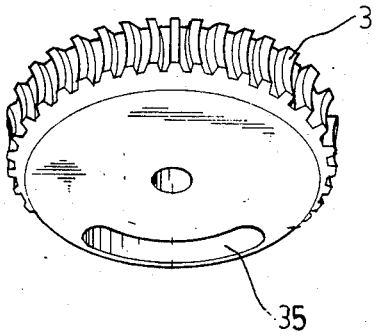
FIG. 3 is a perspective view showing the bottom of the main worm gear of the improved mount for parabolic antenna.
Figure 4:
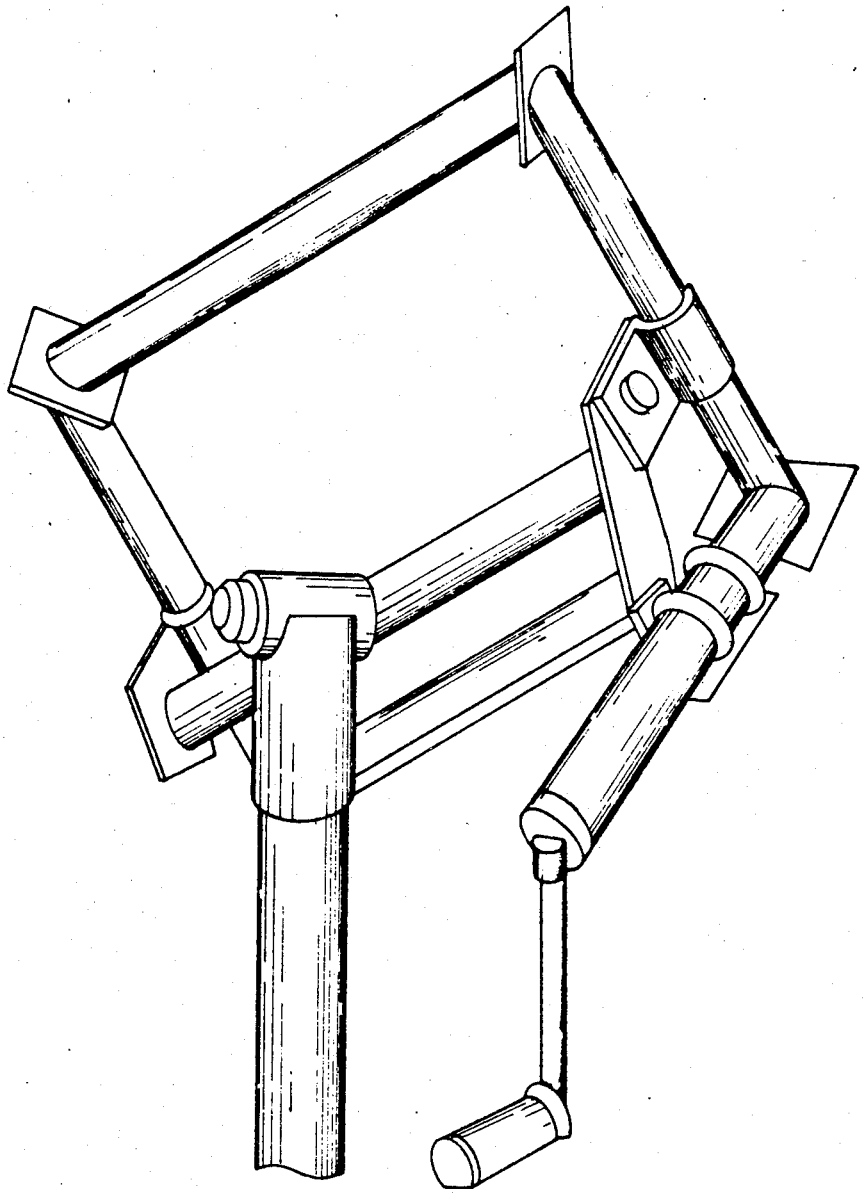
PRIOR ART FIG4
FIG. 4 shows a prior art mount for parabolic antenna.

Referring to the drawings and in particular to FIG. 2 thereof, the improved mount for parabolic antenna according to the present invention comprises a base 1. The base 1 is formed at the upper part with a web 10 having a hole 11 and at the vertical outer surface with a number of threaded holes 13. A swivel table 2 with two parallel lugs 21 each having a hole 211 is rotatably mounted on the base 1 by a screw 12 extending through the holes 211 of the lugs 21 and the hole 11 of the web 10 of the base 1 to engage with a nut 73. The base 1 has a fixing portion 26 for mounting a motor (not shown) and an engaging portion 25 for supporting a driven rod 4. The fixing portion 26 and the engaging portion 25 are separated by a recess 256. On the fixing portion 26 is fastened a gear box 261 in which there is a driving rod 5. The gear box 261 is covered with a lid 262 having an opening from which the driving rod 5 protrudes. The driving rod 5 has an upper end 51 extending upwardly through the lid 262 to connect with a motor (not shown) and a worm 52 disposed in the gear box 261. The engaging portion 25 is provided on the top with a block 251 having a hole 252 within which is mounted a bearing 253. Both of the fixing portion 26 and the engaging portion 25 of the swivel table 2 have a projection 23 on the bottom. Each of the projections 23 is connected with a linking arm 27 by means of a screw 255. The linking arm 27 has a slot 271 and is secured to the base 1 by a screw 272 extending through the slot 271 to threadedly engaged with a hole 13 of the base 1. The swivel table 2 further has a threaded hole 28 at the center and a protuberance 24 on the upper surface.

On the swivel table 2 there is a main worm gear 3 provided with a platform 32 having a hole 33 within which is disposed a bearing 34. A screw 22 extends through the bearing 34 to engage with the threaded hole 28 of the swivel table 2, so that the main worm gear 3 can be rotated with respect to the swivel table 2. The main worm gear 3 has four threaded holes 38 (only two of them are shown) and a groove 35 formed in the bottom thereof. The groove 35 preferably subtends an angle of 120°. A pad 36 having a recess 361 is mounted between the swivel table 2 and the worm gear 3. The pad 36 is coated with teflon thereby reducing the friction between the main worm gear 3 and the pad 36. The main worm gear 3 is mounted on the swivel table 2 in a way such that the groove 35 of the main worm gear 3 houses the protuberance 24 of the swivel table 2. Consequently, the main worm gear 3 can be rotated within an angle of 120°. It will be noted that the length of the groove 35 can be made longer or shorter as required so that the main worm gear 3 can be rotated within any desired angle.

A supporting frame 6 having a notch 621 is secured on the main worm gear 3 by screws 623, with the notch 621 engaged with the platform 32 of the main worm gear 3. The supporting frame 6 is provided with four legs 61 on which a parabolic antenna (not shown) or the like can be mounted.

A driven rod 4 is mounted between the gear box 261 and the block 251. The driven rod 4 is formed at one end with a worm gear 42 and at the middle portion with a worm 41. The worm gear 42 of the driven rod 4 extends into the gear box 261 to mesh with the worm 52 while the other end 43 of the driven rod 4 is connected with the bearing 253 disposed in the hole 252 of the block 251 of the engaging portion 25. The worm 41 of the driven rod 4 is engaged with the worm gear 3. Furthermore, an adjusting screw 265 is threadedly engaged with the hole 252 of the block 251 so as to prevent the driven rod 4 from moving along its axial direction.

To change the horizontal angle of the supporting frame 6, simply turn on the motor (not shown). As the motor (not shown) drives the driving rod 5, the driven rod 4 will be rotated which in turn drives the main worm gear 3, thereby changing the horizontal angle of the supporting frame 6.

When desired to alter the angle of elevation, simply release the screws 272 to adjust the inclination of the swivel table 2.

Although this invention has been described with a certain degree of particularity, it is understood that the present disclosure has been made by way of example only and that numerous changes in the detail of construction and the combination and arrangement of parts should be resorted to without departing from the spirit and the scope of the invention as hereinafter claimed.

I claim:

1. An improved mount for a parabolic antenna comprising:

a base formed at the upper part with a web and at the vertical outer surface with a number of threaded holes;

a swivel table having two parallel lugs at the bottom, a threaded hole at the center and a protuberance on the upper surface, said swivel table being rotatably mounted on said base by a screw extending through the web of said base and the lugs of said swivel table to engage with a nut, said swivel table further having a fixing portion and an engaging portion separated by a recess, both of said fixing portion and said engaging portion having a projection on the bottom;

a gear box fastened on the fixing portion of said swivel table, said gear box being covered with a lid having an opening, a driving rod having at one end a worm disposed in said gear box and protruding from the opening of said lid of said gear box, said driving rod having an upper end engageable with a motor;

a block provided on the engaging portion of said swivel table, said block having a hole within which is mounted a bearing;

a first linking arm secured at one end to the projection of said fixing portion and at the other end to the vertical outer surface of said base;

a second linking arm secured at one end to the projection of said engaging portion and at the other end with the vertical outer surface of said base;

a main worm gear having a groove at the bottom thereof, said worm gear being rotatably mounted on said swivel table with the groove of said worm gear housing the protuberance of said swivel table;

a driven rod having at one end a worm gear and at the middle portion a worm, the worm gear of said driven rod being disposed in said gear box and engaged with the worm of said driving rod, the worm of said driven rod meshing with said main worm gear; and a supporting frame fixed on said main worm gear and capable of rotating therewith, said supporting frame having four legs for holding a parabolic antenna.

2. An improved mount for a parabolic antenna as claimed in claim 1, wherein said groove of said main worm gear preferably subtends an angle of 120°.

3. An improved mount for a parabolic antenna as claimed in claim 1, including a pad coated with Teflon.

4. An improved mount for a parabolic antenna as claimed in claim 1, further comprising an adjusting screw threadedly engaged with said block so as to prevent said driven rod from moving along its axial direction.

* * * * *